US005390766A

United States Patent [19]

Martin

[11] Patent Number: 5,390,766

[45] Date of Patent: Feb. 21, 1995

[54] INDICATOR PANEL FOR ELEVATOR CARS HAVING AN EMERGENCY CALLING DEVICE DOOR HANDLE WITH INFORMATION AND OPERATING AIDS

[75] Inventor: Adolf H. Martin, Glenview, Ill.

[73] Assignee: Inventio AG, Hergiswil, Switzerland

[21] Appl. No.: 96,868

[22] Filed: Jul. 26, 1993

[51] Int. Cl.[6] ..... B25G 1/00

[52] U.S. Cl. ..... 187/396; 187/414; D8/300; 16/DIG. 19

[58] Field of Search ..... 187/121, 130, 1 R, 140, 187/139; D8/300, 301, 315, 316, 317, 318, 319; 312/244; 16/DIG. 19; 40/642; D12/190, 196; D25/37; D34/33

[56] References Cited

U.S. PATENT DOCUMENTS

| | | | |
|---|---|---|---|
| D. 182,170 | 2/1958 | Fink . | |
| D. 195,117 | 4/1963 | Brounn | D25/37 |
| D. 197,700 | 3/1964 | Myers . | |
| D. 219,278 | 11/1970 | Protzmann . | |
| D. 223,340 | 4/1972 | Brounn | D25/37 |
| D. 253,031 | 10/1979 | Gidseg | D8/301 |
| D. 253,940 | 1/1980 | Bedel | D10/108 |
| D. 339,543 | 9/1993 | Martin | D10/108 |
| 3,800,089 | 3/1974 | Reddick | 179/1 HF |
| 4,742,198 | 5/1988 | Martin et al. | 200/296 |
| 5,245,744 | 9/1993 | Edgerton | 29/525 |
| 5,251,758 | 10/1993 | Kolacek | 206/542 |

FOREIGN PATENT DOCUMENTS

| | | | |
|---|---|---|---|
| 3018570 | 1/1991 | Japan . | |
| 4-43783 | 8/1992 | Japan | 187/139 |

*Primary Examiner*—Steven L. Stephan
*Assistant Examiner*—Robert Nappi
*Attorney, Agent, or Firm*—Howard & Howard Atty.

[57] ABSTRACT

An indicator panel for an elevator car has a door behind which an emergency calling device is located for users of the elevator. The door is opened and closed by a door handle attached to the outer surface of the door. The handle has a body with a raised printed character formed on a front surface for identifying the emergency calling device. An enlarged lower portion of the front surface is formed by an outwardly extending flange spaced from a rear surface of the body and serving as a door operating aid. A raised information aid is formed on the enlarged lower portion and includes at least one Braille character identifying the emergency calling device. A further door operating aid is a recess formed in the rear surface of the body for retaining a pencil or the like. The body and the printed character can be formed by molding different color materials with the printed character extending from a cavity formed in the rear surface through an aperture in the front surface.

14 Claims, 2 Drawing Sheets

INDICATOR PANEL FOR ELEVATOR CARS HAVING AN EMERGENCY CALLING DEVICE DOOR HANDLE WITH INFORMATION AND OPERATING AIDS

BACKGROUND OF THE INVENTION

The present invention relates generally to an indicator panel for an elevator car and, in particular, to an emergency calling device door handle having information and operating aids for use by disabled persons.

Indicator panels with operating elements and indicating elements for use in elevator cars have been provided devices for making an emergency call such as a telephone. Typically, the telephone is located in the housing of the indicator panel and is accessible to the elevator user by opening a door attached to the panel. The door is hinged and can be opened and closed by a door handle. In order to inform the user of the elevator that an emergency call device is available behind the door, a printed character, such as a word or a symbol, is formed on the door handle. The same printed character is also formed as one or more Braille characters on a plate attached to the door near the door handle. For better protection against vandalism, the plate has been embedded in a stamped recess in the outer surface of the door.

A drawback of these known devices is that the application of additional plates results in increased labor and material costs. Furthermore, the aesthetic make-up of the entire indicator panel is diminished.

SUMMARY OF THE INVENTION

The present invention concerns an indicator panel with a hinged door for elevator cars. Mounted on the indicator panel are a plurality of operating elements and indicating elements and associated marking signs. A handle is attached to the door and an emergency calling device is located behind the door. The handle has a body having a front surface facing a user when the body is attached to an outer surface of the door and a rear surface for abutting the door. At least one raised printed character is formed on the front surface of the body for indicating information about the emergency calling device to a user of an elevator. A raised information aid is formed on the front surface of the body for indicating information about the emergency calling device to a visually disabled user of the elevator, the information aid including at least one Braille character.

An operating aid is formed on the body for use by a physically disabled user of the elevator for opening the door of the elevator indicator panel. The operating aid is an enlarged lower portion of the front surface of the handle body formed by a flange extending outwardly from the body and spaced from the rear surface and the information aid is formed on the enlarged lower portion. The operating aid also includes a recess formed in the rear surface of the body for inserting a long slender object. A pair of apertures are formed in the rear surface of the body for retaining fasteners for attaching the body to the door. The handle body can be formed of a first color material and the printed character can be formal of a second color material which contrasts with the first color. The front surface of the body has an aperture formed in the shape of the printed character, the rear surface of the body has a cavity formed therein and the printed character extends from the cavity through the aperture.

The present invention solves the problem and avoids the drawbacks of the known devices with a door handle for handicapped users of the elevator.

An advantage of the invention is that the door handle informs the handicapped persons of the existence of an emergency calling device behind the door and facilitates the opening of the door.

A further advantage is that the manufacture of the door can be simplified and made less costly and that the installation of the door handle can be accomplished with less time and effort.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
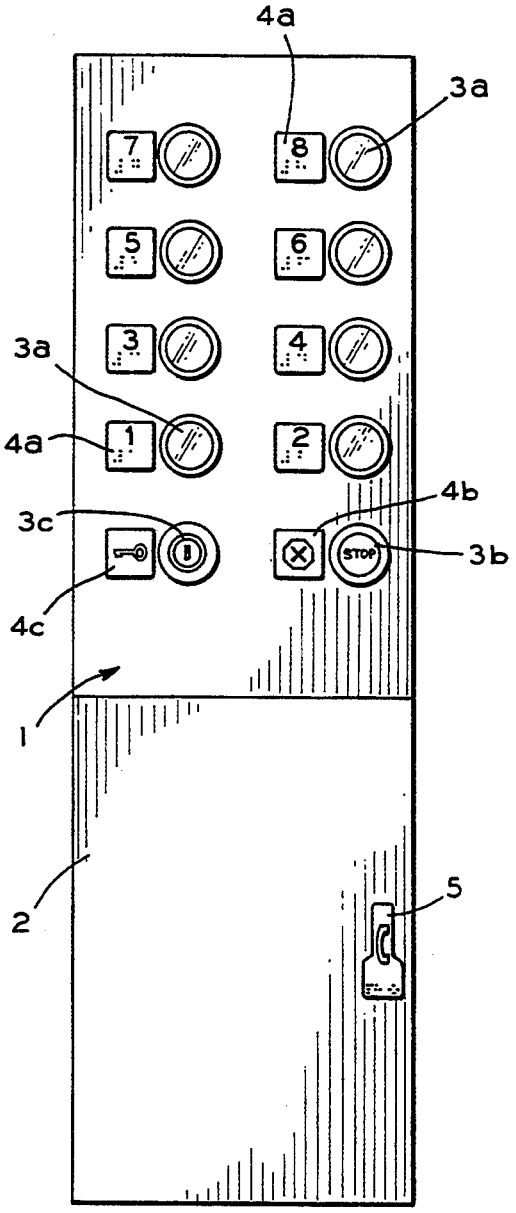
FIG. 1 is a front elevation view of an indicator board with door and door handle for elevators in accordance with the present invention.
Figure 2:
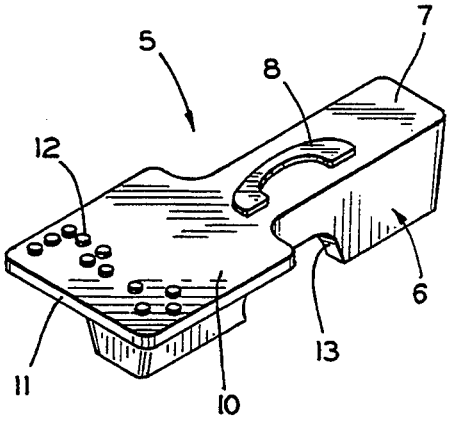
FIG. 2 is an enlarged perspective view of the handle shown in the FIG. 1.
Figure 3:
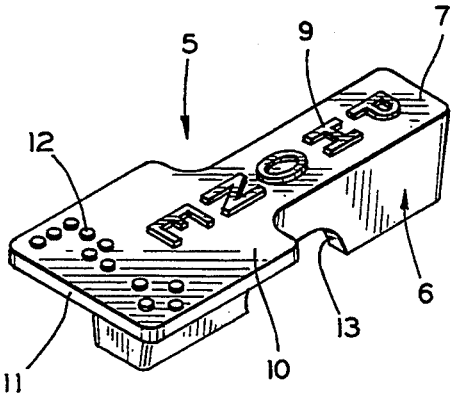
FIG. 3 is an enlarged perspective view of an alternate embodiment of the handle shown in the FIG. 2.
Figure 4:
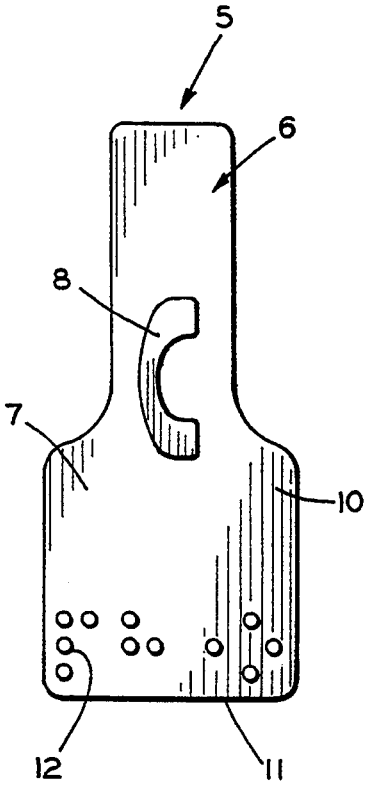
FIG. 4 is a front elevation view of the handle shown in the FIG. 2.
Figure 5:
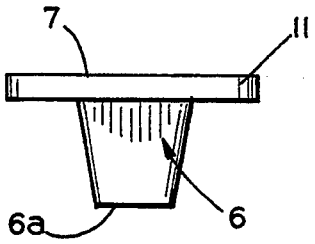
FIG. 5 is a bottom elevation view of the handle shown in the FIG. 2.
Figure 6:
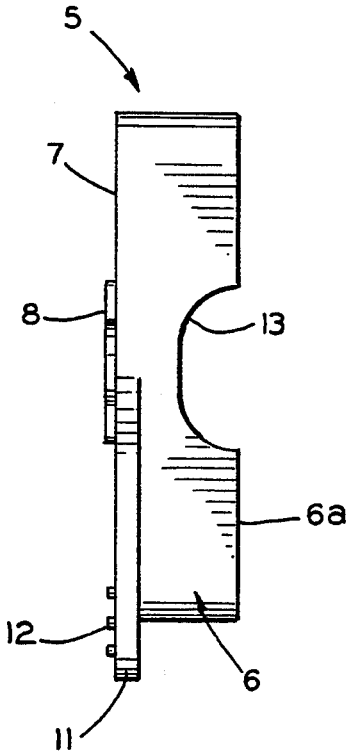
FIG. 6 is a side elevation view of the handle shown in the FIG. 2.
Figure 7:
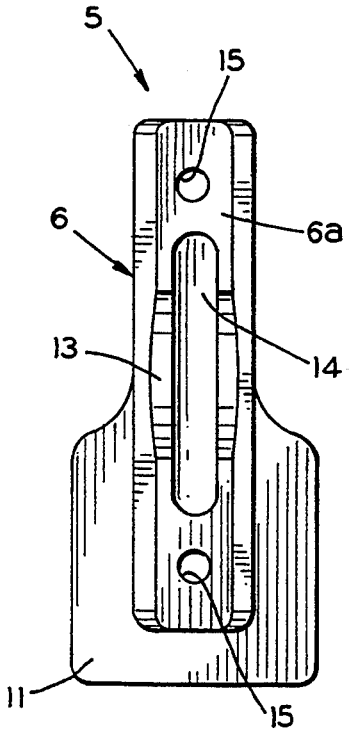
FIG. 7 is a rear elevation view of the handle shown in the FIG. 2.

There is shown in the FIG. 1 a front side of an indicator panel 1 with a door 2 for use in elevator cars. Mounted on and extending through an upper portion of the panel 1 are a plurality of operating elements and signalling elements, such as floor indicating lamps 3*a*, a push button switch 3*b* for entering a stop command and a key actuated switch 3*c* for changing the mode of operation of the elevator. Attached to a front or outer surface of the indicator board 1 are a plurality of marking signs which are positioned to the immediate left of associated ones of each of the elements 3*a*, 3*b* and 3*c*. For example, marking signs 4*a* are associated with the lamps 3*a* and display markings representing the corresponding floor numbers in both printed characters and Braille characters. Although Arabic numerals are shown, the printed characters could be in any recognizable form. The Braille characters are provided as an information aid to elevator users having vision disabilities. A marking sign 4*b* is associated with the push button switch 3*b* and displays a printed character in an octagonal outline with an "X" in the center. A marking sign 4*c* is associated with the key actuated switch 3*c* and displays a printed character in an outline of a key.

The door 2 forms a lower portion of the panel 1 and is hinged (not shown) along a left side thereof. The door 2 is opened and closed by means of a door handle 5 attached to a front or outer surface of the door adjacent a right edge thereof. Located behind the door 2 is an emergency calling device (not shown), such as a telephone set.

As shown in the FIGS. 1 through 7, the door handle 5 has a generally rectangular body 6 which tapers outwardly from a narrower rear surface 6a which abuts the front surface of the door 2 to a broader front surface 7 which faces the user. Located on the front surface 7, facing the user, is a raised printed character 8 such as a telephone handset representing the emergency calling device located behind the door 2. In the alternative, as shown in the FIG. 3, a raised printed character 9 is in the form of the word "phone" indicating the emergency calling device. A lower enlarged portion 10 of the surface 7 is formed by a flange 11 extending from the sides and lower end of the body 6 and spaced from the rear surface 6a. The enlarged portion 10 has an information aid formed thereon in the form of a raised Braille characters 12 which indicate the emergency calling device behind the door 2. In addition to providing space for the Braille characters 12, the flange 11 functions as an operating aid by improving the gripping capacity of the door handle 5, which facilitates the opening of the door 2 for users of the elevator who might have physical disabilities such as difficulty gripping small objects. As a further operating aid for opening the door 2, the body 6 has a recess 13 formed in the rear surface 6a which makes it possible to open the door 2 using a long slender object, such as a pencil. Formed in the rear surface 6a is a cavity 14 which extends through and beyond the recess 13. Between upper and lower ends of the cavity 14 and adjacent upper and lower ends of the body 6 are formed a pair of apertures 15 which are engaged by self-tapping fasteners (not shown) which extend from the rear surface (not shown) of the door 2 through apertures in the door to attach the door handle 5 to the door 2.

In the preferred embodiment, the door handle 5 is manufactured by the injection molding process of synthetic material, for example a black color polycarbonate resin. The raised printed character 8 or the raised printed character 9 is produced in a further working step by the same process. The cavity 14 provides access to the underside of the front surface 7 in which apertures in the shape of the desired character were formed in the first molding step. A contrasting colored synthetic material, for example a white color polycarbonate resin, is injected through the cavity 14 and emerges from the apertures in the surface 7 to form the raised character in the second molding step.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An indicator panel with hinged door for elevator cars, a plurality of operating elements and indicating elements mounted on the panel, a handle attached to the door, and an emergency calling device crated behind the door, the handle comprising:

a body having a front surface facing a us when said body is attached to an outer surface of a door of an elevator indicator panel;

at least one raised printed character form on said front surface of said body for indicating information about an emergency calling device to a user of an elevator;

a raised information aid formed on said front surface of said body for indicating information about an emergency calling device to a visually disabled user of an elevator, said front surface of said body including an enlarged lower portion formed by a flange extending outwardly from said body, and said information aid being formed on said enlarged lower portion; and an operating aid formed on said body for use by a physically disabled user of an elevator for opening a door of an elevator indicator panel.

2. The indicator panel according to claim 1 wherein said information aid is at least one Braille character.

3. The indicator panel according to claim 1 wherein said operating aid is said enlarged lower portion of said front surface formed by a flange extending outwardly from said body and spaced from said rear surface of said body.

4. The indicator panel according to claim 1 wherein said operating aid is a recess formed in said rear surface of said body for inserting a long slender object.

5. An indicator panel with a hinged door for elevator cars, a plurality of operating elements and indicating elements mounted on the panel, a handle attached to the door, and an emergency calling device located behind the door, the handle comprising:

a body having a front surface facing a user when said body is attached to an outer surface of a door of an elevator indicator panel and a rear surface for abutting the door;

at least one raised printed character formed on said front surface of said body for indicating information about an emergency calling device to a user of an elevator;

a raised information aid formed on said front surface of said body for indicating information about an emergency calling device to a visually disabled user of an elevator, said information aid including at least one Braille character; and an operating aid formed on said body for use by a physically disabled user of an elevator for opening a door of an elevator indicator panel, said operating aid being an enlarged lower portion of said front surface formed by a flange extending outwardly from said body and spaced from rear surface of said body and said information aid also being formed on said enlarged lower portion.

6. The indicator panel according to claim 5 wherein said operating aid also includes a recess formed in said rear surface of said body tier inserting a long slender object.

7. The indicator panel according to claim 5 including a pair of apertures formed in said rear surface of said body for retaining fasteners for attaching said body to an indicator panel door, wherein said body has a first color and said printed character has a second color which contrasts with said first color and said front surface has an aperture in a shape of said printed character formed therein, said rear surface of said body has a cavity formed therein and said printed character extends from said cavity through said aperture.

8. A handle for attachment to a hinged door of an indicator panel for elevator cars comprising:

a body having a front surface facing a user when said body is attached to an outer surface of a door of an elevator indicator panel;

at least one raised printed character formed on said front since of said body for indicating information about an emergency calling device to a user of an elevator;

a raised information aid formed on said front surface of said body for indicating information about an emergency calling device to a visually disabled user of an elevator, said front surface of said body including an enlarged lower portion formed by a flange extending outwardly from said body, and said information aid being formed on said enlarged lower portion; an an operating aid formed on said body for use by a physically disabled user of an elevator for opening a door of an elevator indicator panel.

9. The handle according to claim 8 wherein said information aid is at least one Braille character.

10. The handle according to claim 8 wherein said operating aid is said enlarged lower portion of said front surface formed by a flange extending outwardly from said body and spaced from said rear surface of said body.

11. The handle according to claim 8 wherein said operating aid is a recess formed in said rear surface of said body for inserting a long slender object.

12. The handle according to claim 8 including a pair of apertures formed in said rear surface of said body for retaining fasteners for attaching said body to an indicator panel door.

13. The handle according to claim 8 wherein said body has a first color and said printed character has a second color which contrasts with said first color.

14. The handle according to claim 13 wherein said front surface has an aperture in a shape of said printed character formed therein, said rear surface of said body has a cavity formed therein and said printed character extends from said cavity through said aperture.

* * * * *